US009142197B2

(12) United States Patent
Oldfield

(10) Patent No.: US 9,142,197 B2
(45) Date of Patent: Sep. 22, 2015

(54) VIBRATO BLOCK

(71) Applicant: Towner USA, LLC, San Diego, CA (US)

(72) Inventor: Andrew Oldfield, San Diego, CA (US)

(73) Assignee: Towner USA, LLC, San Diego, CA (US)

( * ) Notice: Subject to any disclaimer, the term of this patent is extended or adjusted under 35 U.S.C. 154(b) by 0 days.

(21) Appl. No.: 14/203,441

(22) Filed: Mar. 10, 2014

(65) Prior Publication Data

US 2015/0068386 A1 Mar. 12, 2015

Related U.S. Application Data

(60) Provisional application No. 61/775,460, filed on Mar. 8, 2013.

(51) Int. Cl.

| | |
|---|---|
| ***G10D 3/00*** | (2006.01) |
| ***G10D 3/14*** | (2006.01) |
| ***G10D 1/08*** | (2006.01) |

(52) U.S. Cl.

CPC ..... *G10D 3/146* (2013.01); *G10D 1/085* (2013.01)

(58) Field of Classification Search

CPC ..... G10D 3/146; G10D 1/085

See application file for complete search history.

(56) References Cited

U.S. PATENT DOCUMENTS

| | | | | | |
|---|---|---|---|---|---|
| D169,120 | S | * | 3/1953 | Bigsby | D17/21 |
| D170,109 | S | * | 8/1953 | Bigsby | D17/21 |
| 2,781,685 | A | * | 2/1957 | White et al. | 84/312 R |
| 3,162,083 | A | * | 12/1964 | Webster | 84/313 |
| 3,422,509 | A | * | 1/1969 | Porter | 84/313 |
| 3,457,821 | A | * | 7/1969 | Huis et al. | 84/313 |
| 3,500,711 | A | * | 3/1970 | Fender | 84/313 |
| 3,990,341 | A | * | 11/1976 | Pace, Sr. | 84/313 |
| 4,100,832 | A | * | 7/1978 | Peterson | 84/313 |
| 7,709,713 | B1 | * | 5/2010 | Pearce et al. | 84/313 |
| 7,812,232 | B2 | * | 10/2010 | Dennis | 84/299 |
| 7,973,226 | B2 | * | 7/2011 | Towner | 84/312 R |
| 8,071,868 | B2 | * | 12/2011 | Dennis | 84/313 |
| 8,163,987 | B1 | * | 4/2012 | Dennis | 84/313 |
| 8,678,659 | B2 | * | 3/2014 | Miller et al. | 384/313 |
| D719,212 | S | * | 12/2014 | Dennis | D17/21 |
| 2014/0230628 | A1 | * | 8/2014 | Hunter et al. | 84/297 R |
| 2015/0068386 | A1 | * | 3/2015 | Oldfield | 84/403 |

* cited by examiner

*Primary Examiner* — Robert W Horn

(74) *Attorney, Agent, or Firm* — Gary L. Eastman, Esq.

(57) ABSTRACT

The Vibrato Block securely attaches a vibrato device to a guitar without permanent physical modifications to the guitar and provides clearance for the guitar's tailpiece mounting holes for utilization by other guitar accessories. The Vibrato Block consists of a body having a curved guitar contact surface with an attached non-marring, high-friction pad and a mounting plate contact surface corresponding to the vibrato devices mounting plate surface. The Vibrato Block is formed with an internal slot and a plurality of mounting holes. The thickness of the Vibrato Block and adjustability provided by the internal slot enables optimal placement of the vibrato device and unobstructed tailpiece mounting holes. The vibrato device is mounted to the Vibrato Block whereas the Vibrato Block is mounted to the guitar using only the guitar's rear strap button screw mounting point and a fastener, thereby avoiding any physical modifications to the guitar.

15 Claims, 6 Drawing Sheets

VIBRATO BLOCK

RELATED APPLICATION

This application claims the benefit of priority to U.S. Provisional Patent Application Ser. No. 61/775,460 filed Mar. 8, 2013, entitled "Vibrato Block."

FIELD OF INVENTION

The present invention relates generally to guitars and guitar accessories. The present invention is more particularly, though not exclusively, related to electric guitar accessories.

BACKGROUND OF THE INVENTION

Since their invention in the 1930s, the electric guitar has been a mainstay in music and has been instrumental in the development of rock and roll and many other genres of music due to its ability to create a variety of sounds and styles. The unique combination of parts coupled with electronic amplification allows the electric guitar to produce their unique sounds and styles. Generally, the electric guitar comprises a body, a neck, headstock, tuning pegs, fret board, frets, pickups, bridge, tailpiece, guitar strings, and strap button screws. The head stock is connected to the neck which is connected to the body, creating the general shape and structure of the guitar. The guitar strings are strung from the headstock, down the neck across the fret board towards the body, passing over the pickups and bridge as they terminate at the tailpiece. At the headstock, the tension of the guitar strings can be adjusted by turning the tuning pegs. The pickups detect the movement of the strings and converts and transmit the string movements into electric signals which is then amplified and turned into sound by an electronic amplifier. Each pluck of a guitar string representing a musical note.

Achieving a vibrato effect, a change in pitch of a musical note, has always been desirable in guitars ever since its invention. Before the invention of vibrato devices for guitars, guitarist achieved the vibrato effect by using their fingers and pressing down on the string against a fret on the fret board and wobbling their fingers back and forth. To produce a wider vibrato effect, instead of wobbling their fingers in one location, guitarist slid their fingers up and down the neck while simultaneously pressing down on the string against the frets on the fret board. Using these methods, guitarists were able to achieve the vibrato effect on only the strings they were able to hold down with their fingers. The introduction of vibrato devices allowed guitarist to create a vibrato effect on all of the strings simultaneously. The vibrato device produces a vibrato effect by changing the tension of all the guitar strings simultaneously using a single control lever, also known as a whammy or a vibrato bar.

An exemplary example of a vibrato device is the Bigsby® B3 vibrato device comprising of only a single string bar serving as a tension and hold bar. The Vibrato device includes a spring loaded control lever (whammy/vibrato bar) fixedly attached to a string hold bar, housed in a solid body for attachment to a guitar. The vibrato device is attached towards the rear, top surface of the guitar by replacing the bridge, the tailpiece, or both. The guitar strings are then attached to the string hold bar of the vibrato device instead of the original tailpiece of the guitar. When the control lever is pushed downwards, the string bar rotates towards the direction of the guitar strings, relieving tension and creating a low pitch. When the control lever is pulled upwards, the string bar rotates away creating additional tension in the guitar strings resulting in a higher pitch. Releasing the control lever to its natural position returns the strings back to its normal tension resulting in the guitars normal pitch.

However, secure attachment of a Bigsby® B3 vibrato device or similar type vibrato devices to a guitar requires permanent physical modifications to the guitar. The attachment of vibrato devices to guitars requires the removal of the tailpiece, possible removal of the bridge and tapping a plurality of holes into the guitar body, ruining the finish and altering the guitars status as an original piece. Additionally, the tone of the instrument and the structural integrity of the guitar may also be compromised. Therefore, it is desirable and advantageous to provide an apparatus which enables the attachment of a Bigsby® B3 vibrato device or similar type vibrato devices to a guitar without permanent physical modifications while preserving the original guitar string dynamics by allowing perfect spacing and alignment of the guitar strings. It is further advantageous to provide a device that will not impede the original location of the tailpiece mounting holes for instances where additional accessories may be attached utilizing the tailpiece mounting points such as the Vibrato Retrofit String Tension Kit described in U.S. Pat. No. 7,973,226.

SUMMARY OF THE INVENTION

The Vibrato Block of the present invention achieves perfect spacing and alignment of the guitar strings to provide tuning stability and perfect intonation by positioning the vibrato device in the optimal location on the guitar body without any permanent physical modifications to the guitar body. The Vibrato Block is dimensioned and shaped according to the footprint of the attachment plate of the vibrato device and is made with a predetermined thickness. The overall footprint of the Vibrator Block is equal to the footprint of the vibrato device's mounting plate to provide a large surface area for the vibrato device to mount. The similar shape and dimension allows the Vibrato Block to blend in with the mounting plate of the vibrato device, making the Vibrato Block and mounting plate combination aesthetically pleasing. The Vibrato Block thickness spaces the vibrato device a distance away from the guitar body to achieve optimal spacing for the guitar strings and to keep the tailpiece mounting holes free from obstruction to allow other accessories to be used which utilize the tailpiece mounting points.

In the center of the block is an internal slot sized to accommodate a guitar's rear strap button screw. The Vibrato Block is attached to the guitar body by screwing the guitar's rear button strap screw through the Vibrato Block's internal slot. Loosening the guitar's rear button strap screw allows the Vibrato Block to traverse along the internal slot, however when tightened the screw will create frictional forces between the rear strap button screw, the Vibrato Block, and the guitar to keep the assembly in place. A non-marring, high-friction pad used to prevent damage to the guitar and increase the stability of the Vibrato Block is placed between the guitar body and the Vibrato Block. The ability of the Vibrato Bock to traverse along the internal slot and adjust the height of the attached vibrato device allows the vibrato device and Vibrato Block to be used on various types of different guitar bodies. The vibrato device is attached to the guitar by mounting itself to the Vibrato Block by utilizing the mounting plate's mounting holes and the corresponding threaded mounting points on the Vibrato Block, removing the need for permanent physical modification to the guitar to attach the vibrato device.

The Vibrato Block of the present invention provides a guitar with a secure mounting point for a vibrato device without the need for permanent physical modifications. Additionally, the Vibrato Block provides adjustability to allow the vibrato device to be used with various types of guitars and achieve the desired tuning and intonation. Leaving the tailpiece mounting points unobstructed, other devices such as the Vibrato Retrofit String Tension Kit described in U.S. Pat. No. 7,973,226 may be used in conjunction with the vibrato device. Additionally, by avoiding the use of the tailpiece mounting points, it is easier and faster to revert the guitar back to its original form.

BRIEF DESCRIPTION OF DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF DRAWINGS

Figure 1:
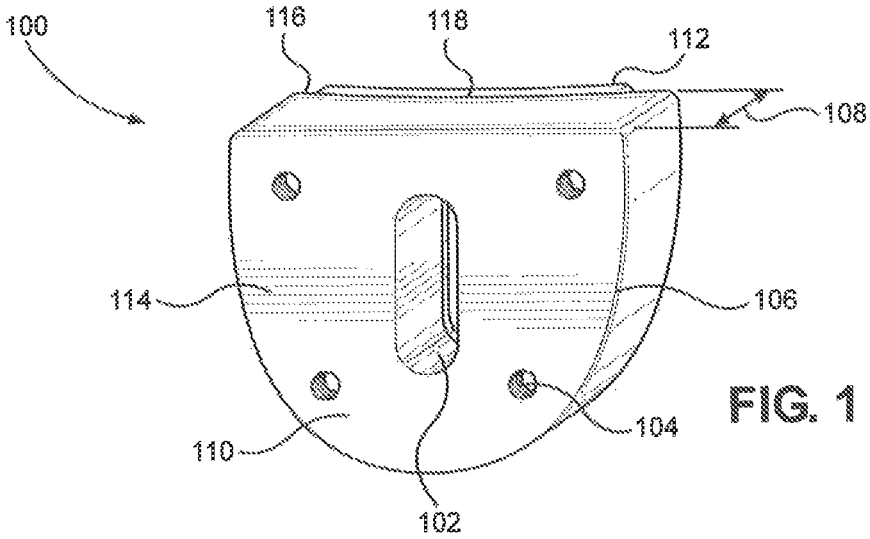
FIG. 1 is a perspective view of the Vibrato Block of the present invention depicting the overall dimensions of the Vibrato block, the internal slot, the mounting points, the thickness, and the non-marring, high friction pad.

Referring initially to FIG. 1, a perspective view of the Vibrato Block 100 of the present invention is shown and includes the main body 110 having a front mounting plate surface 114, a rear guitar contact surface 116 having a slight curvature 118, an internal slot 102, a plurality of mounting holes 104, a footprint 106, a thickness 108, and a non-marring, high-friction pad 112. In approximately the center of body 110 is internal slot 102, formed by removal of a portion of the body 110 material extending from the front mounting plate contact surface 114 to the rear guitar contact surface 116. The plurality of mounting holes 104 are formed on the front mounting plate surface 114 of body 110 and are spaced in predetermined locations. In the preferred embodiment, there are four mounting holes 104 with each mounting hole threaded to receive a corresponding screw. The non-marring, high-friction pad 112 is located on the rear guitar contact surface 116 of the body 110 and can be a floating pad, an attached pad, or a material directly coated onto the rear guitar contact surface 116. The use of the non-marring, high friction pad 112 is optional and the Vibrato Block 100 may be used without it.

Figure 2:
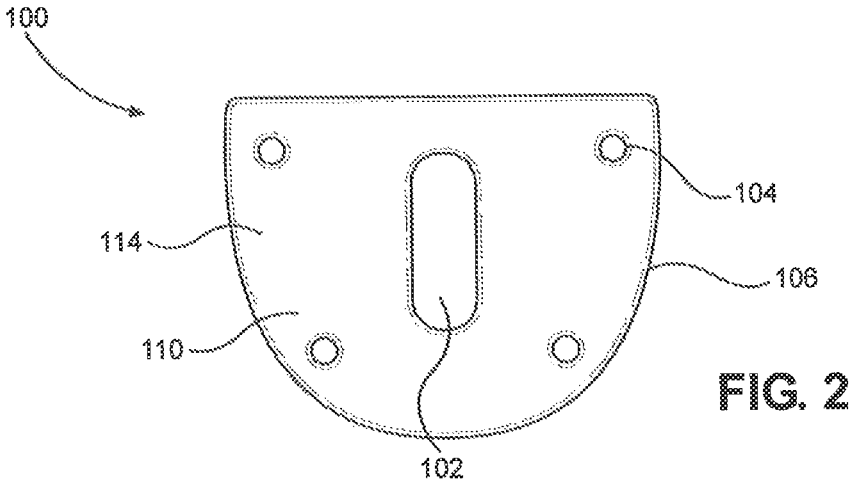
FIG. 2 is a plan view of the Vibrato Block of the present invention showing the footprint, the internal slot, and mounting points.

Referring now to FIG. 2, a front view of the Vibrato Block 100 of the present invention is shown. The internal slot 102 is placed approximately in the middle of the body 110 and extends all the way through, from the front mounting plate surface 114 to the rear guitar contract surface 116. The mounting holes 104 are placed in the body 110 on the front mounting plate surface 114. The body 110 has a footprint 106 defined by the front mounting plate surface 114.

Figure 3:
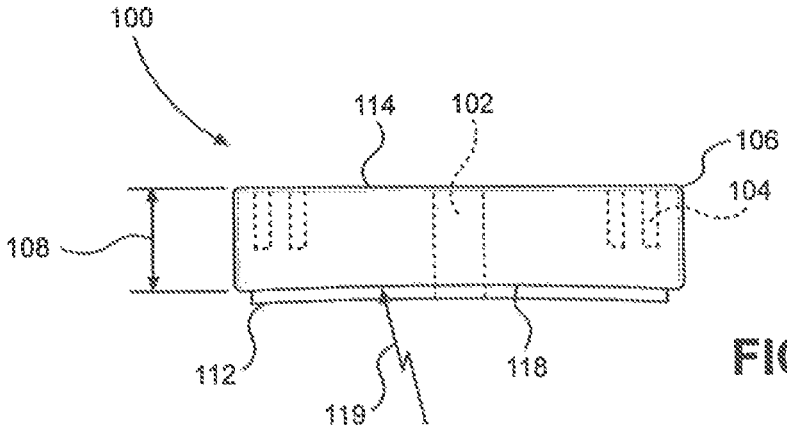
FIG. 3 is a top view of the Vibrato Block of the present invention showing the thickness of the Vibrato Block.

Referring now to FIG. 3, a top view of the Vibrato Block 100 of the present invention is shown. The non-marring, high-friction pad 112 is located on the rear guitar contact surface 116 of the body 110. At approximately the center of the body 110 is internal slot 102. The mounting holes 104 are located towards the edge of the body. The thickness 108 of the Vibrato Block 100 is predetermined based on the spacing needed to position the attached vibrato device 200 for perfect alignment and spacing. The curvature 118 may have a radius 119 that corresponds to the curvature of the guitar body in which the Vibrato Block 100 is being attached to. Alternatively, non-uniform curvatures may be incorporated to cooperate with guitars having different body shapes. The curvature 118 ensures the maximum amount of contact area with the guitar body to provide greater stability and strength to the Vibrato Block 100 and attached vibrato device 200. In certain guitar types, a curvature 118 may not be needed and a flat rear guitar contact surface area 116 may be preferred. The non-marring, high-friction pad 112 increases the stability and strength of the Vibrato Block 100 by providing additional friction between the surfaces and deforming to fill any gaps between the Vibrato Block 100 and the guitar. The use of the non-marring, high friction pad 112 is optional and the Vibrato Block 100 may be used without it. Differing thicknesses 108 and curvatures 118 for the Vibrato Block 100 to accommodate different types of vibrato devices and guitars are fully contemplated without departing from the scope and spirit of the invention.

Figure 4:
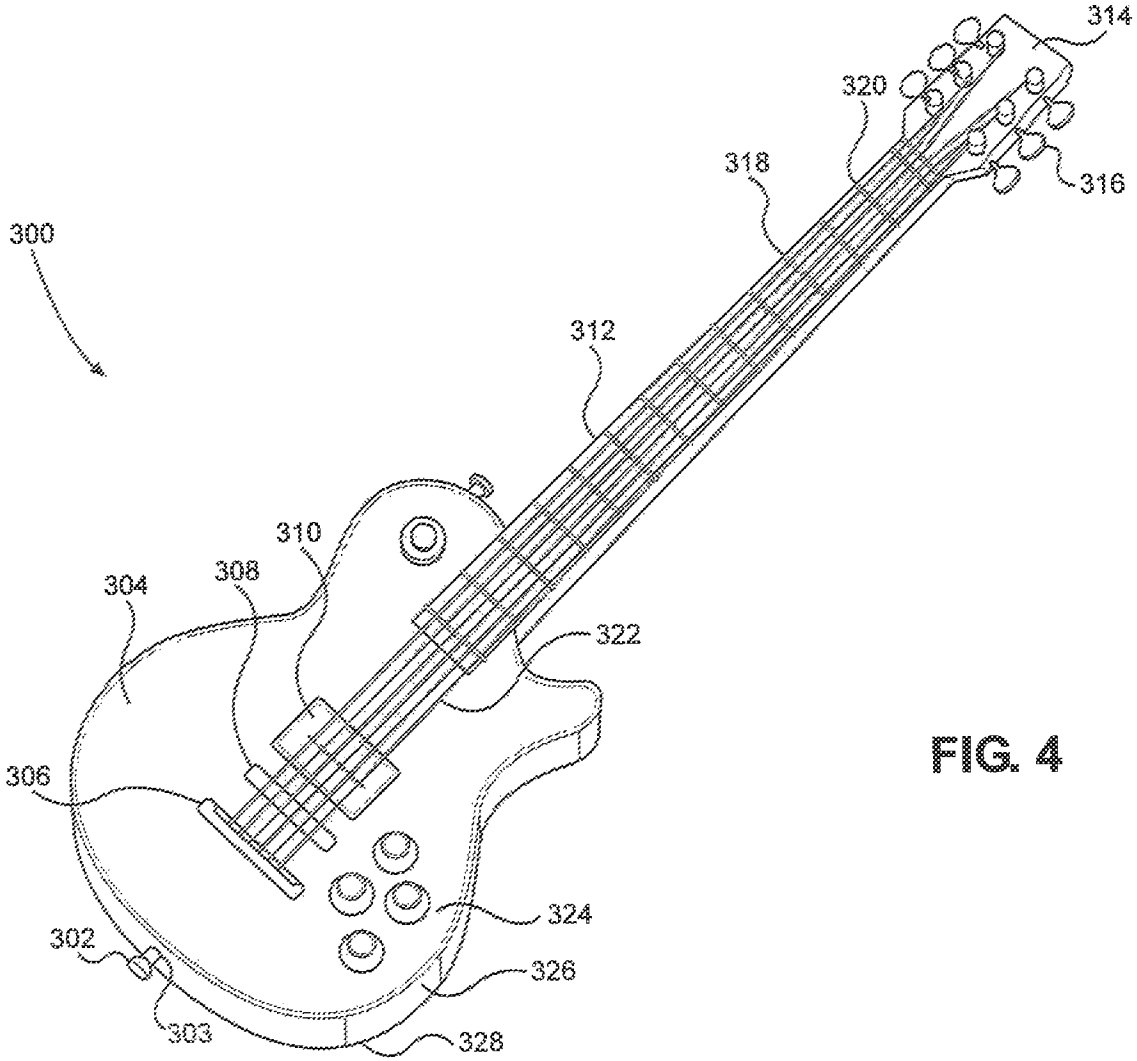
FIG. 4 is a perspective view of an electric guitar.

Referring now to FIG. 4, a perspective view of a generic type electric guitar is shown and generally designated 300. The electric guitar 300 comprises, inter alia, a main body 304 having a front surface 324, an edge surface 326 and a back surface 328, a neck 312, a headstock 314, a fret board 318, a plurality of frets 320, tuning pegs 316, guitar strings 322, a pickup assembly 310, a bridge 308, a tailpiece 306, corresponding tailpiece mounting holes 330 (shown in FIG. 5), rear strap button screw 302, and corresponding rear strap button screw mount 303. The head stock 314 is connected to the neck 318 which is connected to the body 304, creating the general shape and structure of the guitar 300. The guitar strings 322, located on the front surface 324 of the guitar body 304, are strung from the headstock 314 down the neck 312 across the fret board 318 and towards the body 304, passing over the pickups 310, bridge 308, and terminating at the tailpiece 306. The tailpiece 306 and headstock 314 hold the guitar strings 322 securely in place. The pickups 310 detect the movement of the strings 322 and converts and transmit the movement into electric signals which are then amplified and turned into sound by an electronic amplifier.

Figure 5:
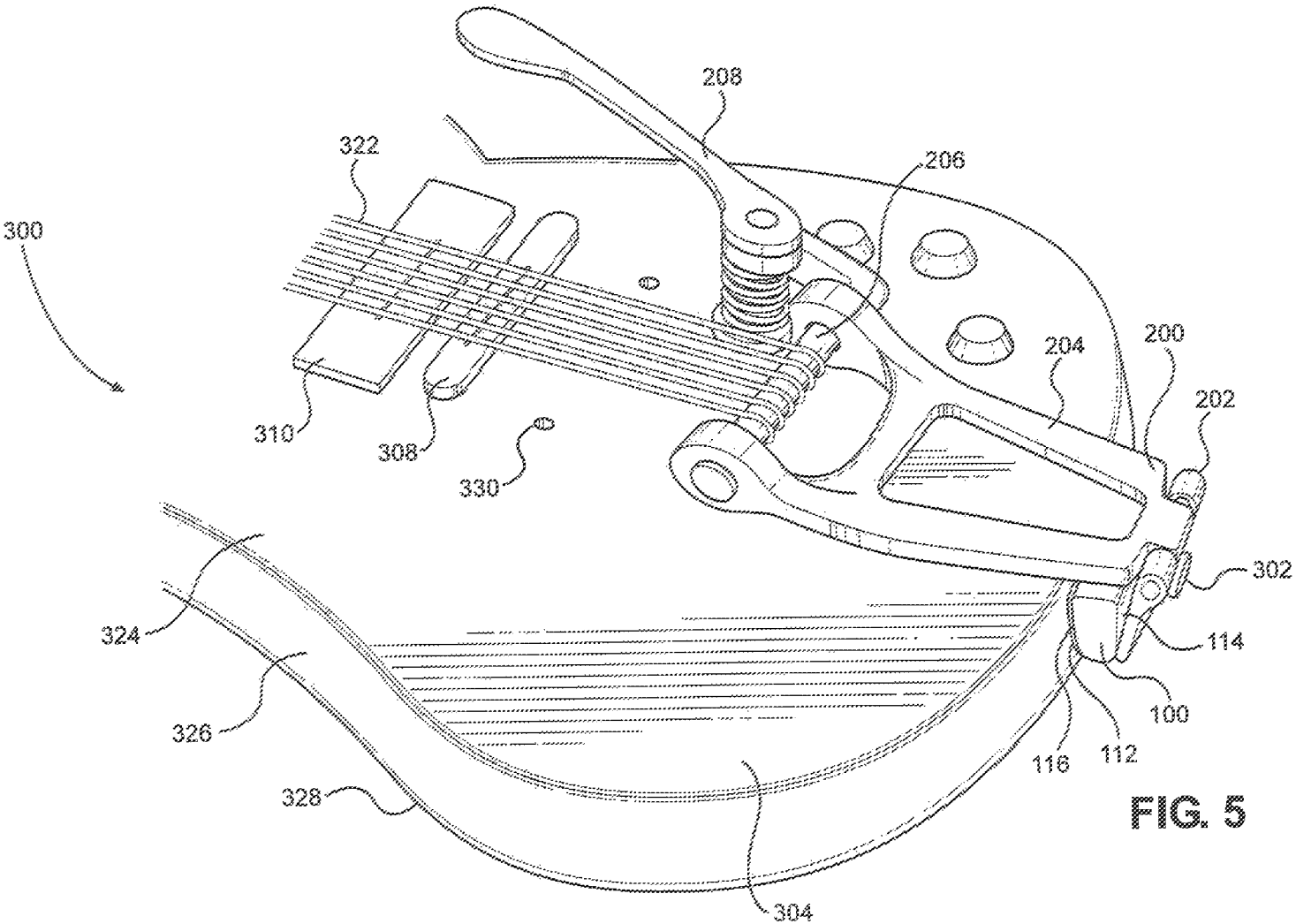
FIG. 5 is a perspective view of a Vibrato Block guitar assembly depicting the relative positions of the Vibrato Block covered and partially concealed by the vibrato device on a guitar.

Referring now to FIG. 5, the Vibrato Block 100 is shown attached to guitar 300 and a vibrato device 200 is attached to the Vibrato Block 100 thereby attaching the vibrato device 200 to the guitar 300 without any permanent physical modifications. In the preferred embodiment, the vibrato device 200 is a Bigsby® B3 or any similar type of vibrato device which includes a mounting plate 202, a main plate 204, a string hold bar 206 and a control lever 208. The mounting plate 202 is further formed with a plurality of mounting holes 212 (shown in FIG. 6) and rear strap button screw pass through 214 (shown in FIG. 6). The guitar strings 322 are removed from the tailpiece 306 and attached to the string hold bar 206 of the vibrato device 200. The tailpiece 306 is removed completely, leaving the tailpiece mounting holes 330 exposed and available for use.

The Vibrato Block 100 is attached to guitar 300 and vibrato device 200 is attached to the Vibrato Block 100. The non-marring, high-friction pad 112 of the Vibrato Block 100 is in contact with the guitar's edge surface 326, providing protection to the guitars surface from damage from the Vibrato Block 100. The non-marring, high-friction pad 112 also increases the stability of the Vibrato Block 100 and attached vibrato device 200. The radius of the curvature 119 of surface 118 of the Vibrato Block 100 is substantially similar to the curvature of the guitar's edge surface 326 to provide maximum contact surface area for maximum stability.

The internal slot 102 of the Vibrato Block 100 is sized to form a clearance fit with the threaded portion of the guitar's rear strap button screw 302 which allows the Vibrato Block 100 to be adjusted along the internal slot 102 when the rear strap button screw 302 is threaded loosely into the corresponding rear strap button screw mount 303 (not shown) on the guitar body 304. The tightening of the rear strap button screw 302 will force the head of the rear strap button screw 302 to come into contact with the mounting plate 202, which in turn presses on the front mounting plate surface 114 of Vibrato Block 100, thereby pressing the non-marring, high friction pad 112 against the guitar edge surface 326 with adequate force to securely hold the Vibrato Block 100 in place. The rear strap button screw 302 may be stock or may be an extended version with an extended threaded portion to accommodate the thickness 108 of the Vibrato Block 100. Alternatively, a screw with a similar thread pattern to rear strap button screw 302 may be used instead of the rear strap button screw 302 in instances where a rear strap button screw 302 is not desired or the use of a rear strap button screw 302 is not plausible.

On the front mounting plate surface 114 of body 110 of the Vibrato Block 100 are mounting holes 104. In the preferred embodiment, there are four mounting holes 104 corresponding to the mounting holes 212 (shown in FIG. 6) of mounting plate 202 of vibrato device 200. Alternative numbers of mounting holes and patterns are fully contemplated without departing from the scope and spirit of the invention as different vibrato devices have different mounting patterns and number of mounting holes. The mounting holes 104 are threaded to accept the stock screws of the vibrato device 200. Alternatively, the mounting holes 104 may be threaded to accept a custom set of screws. The mounting plate 202 of the vibrato device 200 is mounted directly to the body 110 of the Vibrato Block 100 using the stock securing hardware, eliminating the need to directly attach the vibrato device to the guitar body 304.

The footprint 106 of the Vibrato Block 100 is similar to the footprint of the mounting plate 202 of the vibrato device 200. The large surface area of the body 110 allows greater friction between the mounting plate 202 and the front mounting plate surface 114 of body 110 creating a more secure mount. The similar footprints create the appearance of a single continuous piece, creating a sleek and aesthetically pleasing look. The thickness 108 of the Vibrato Block 100 spaces the vibrato block 100 away from the guitar body 304 and the tailpiece mounting holes 330, leaving the tailpiece mounting holes 330 unobstructed and readily available for use. Differing thicknesses 108 and footprints 106 of the Vibrato Block 100 are fully contemplated without departing from the spirit of the invention as similar vibrato devices have different shaped mounting plates and dimensions.

By adjusting the dimensions of the Vibrato Block 100, a variety of different vibrato devices may be attached to any guitar having a rear strap button screw without the need for permanent physical modifications. The ability to adjust the Vibrato Block 100 allows a user to adjust the position of the vibrato device 200 to achieve the tuning and intonation desired. The availability of the tailpiece mounting holes 330 allows the use of additional accessories requiring the use of the tailpiece mounting holes 330.

Figure 6:
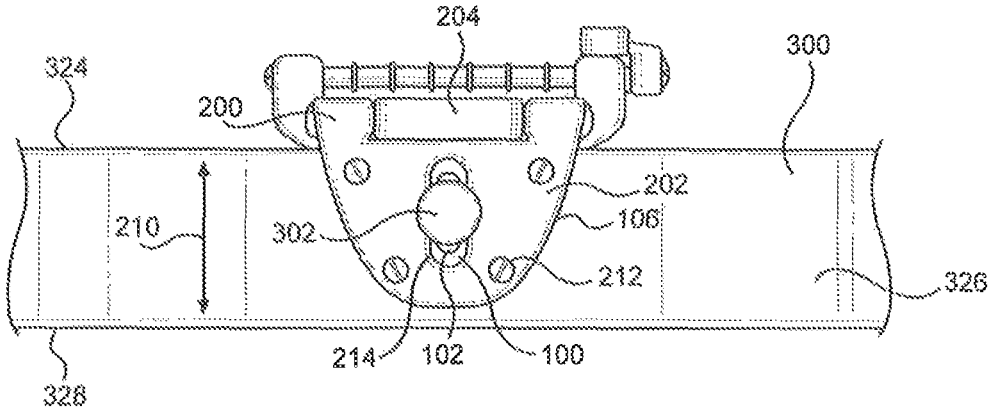
FIG. 6 is a front view of the vibrato device attached to a guitar using the thumb screw, or strap button, and without any physical modifications by utilizing the Vibrato Block and depicting the concealment of the Vibrato Block by the mounting plate of the vibrato device because the footprints of both pieces are equal.

Referring now to FIG. 6, a rear view of guitar 300 is shown with the Vibrato Block 100 and vibrato device 200 attached. The Vibrato Block 100 is attached to the guitar 300, without permanent physical modification, by using the stock rear strap button screw 302 present on the guitar 300. The footprint 106 of the Vibrato Block 100 is substantially similar to the footprint of the mounting plate 200 and therefore is concealed by the mounting plate 200 making the use of the Vibrato Block 100 aesthetically pleasing. The internal slot 102 allows the Vibrato Block 100 to traverse along the internal slot 102, parallel to the guitar's edge surface 326 in the direction 210. The rear strap button screw pass through 214 allows the rear strap button screw 302 to pass through the mounting plate 202 and contact the front mounting plate surface 114. Alternatively, the vibrato device 200 may not have a rear strap button screw pass through 214 and therefore a screw instead of a rear button strap screw 302 will be used in conjunction with the vibrato device 200. The internal slot 102 will then be formed with a counterbore to allow the screw to sit below the front mounting plate surface 114 to allow the vibrato device 200 to sit flush with the front mounting plate surface 114 of the Vibrato Block 100.

The vibrato device 200 is attached to the Vibrato Block 100 using the vibrato device's 200 stock mounting screws. The screws are placed through the mounting holes 212 of the mounting plate 202 and threaded into the corresponding mounting holes 104 (not shown) of the vibrato block 100. By screwing the screws into the Vibrato Block 100 instead of the guitar 300, no permanent physical modifications are made. By avoiding the physical alteration the original status, the aesthetics, the original tone, and the structural integrity of the guitar are maintained.

Figure 7:
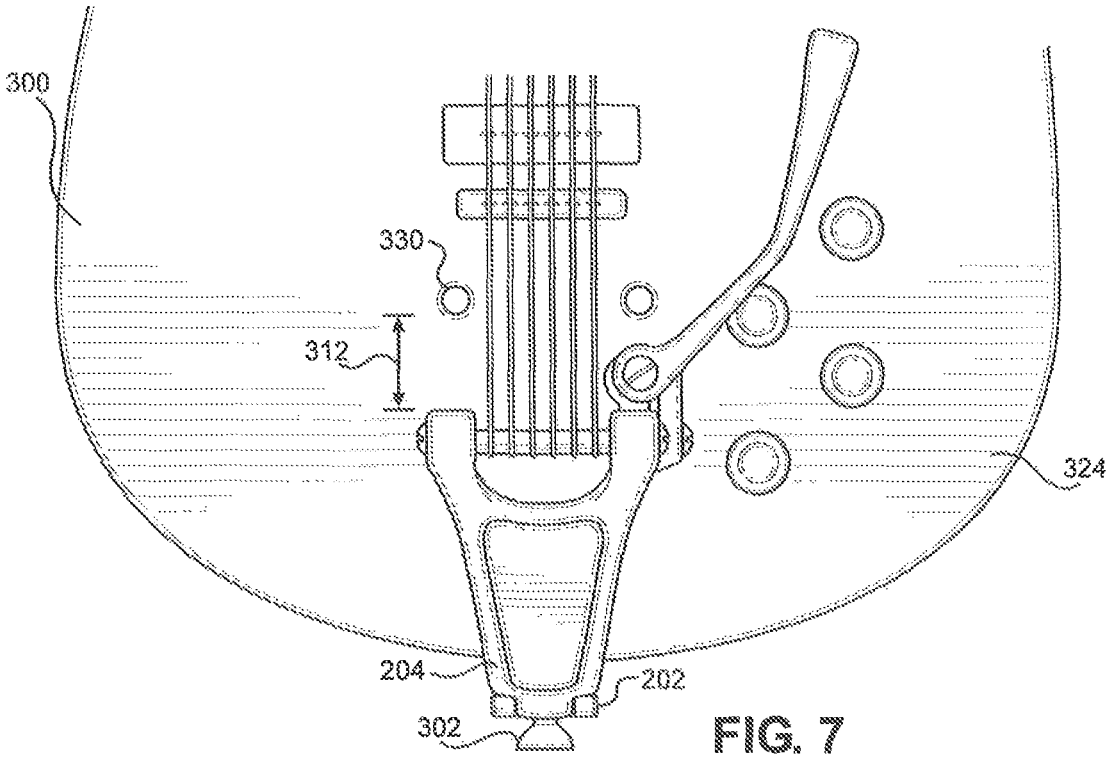
FIG. 7 is a top view of the vibrato device attached to a guitar without any physical modifications by utilizing the Vibrato Block and depicting the relative distance the vibrato device is away from the guitar body to achieve the desired string intonation and tuning and to avoid obstructing the tailpiece mounting holes.

Referring now to FIG. 7, a plan view of the guitar 300 is shown with the Vibrato Block 100 and the vibrato device 200 attached. The footprint 106 of the Vibrato Block 100 is substantially similar to the footprint of the mounting plate 200 and therefore is concealed by the mounting plate 202 and the main plate 204. The thickness 108 of the Vibrato Block 100 spaces the vibrato device 200 a distance 312 away from the tailpiece mounting holes 330. The distance 312 allows the tailpiece mounting holes 330 to be unobstructed by the vibrato device 200 and readily available for use. Accordingly, the thickness 108 of the Vibrato Block 100 and the distance 312 may vary depending on the type of guitar 300 and vibrato device 200 used. A person of ordinary skills in the art will appreciate that the thickness 108 and corresponding distance 312 can be modified to accommodate different types of guitars 300 and vibrato devices 200 in order to achieve the optimal placement of the vibrato device 200 for the desired tuning and guitar string intonation.

Figure 8:
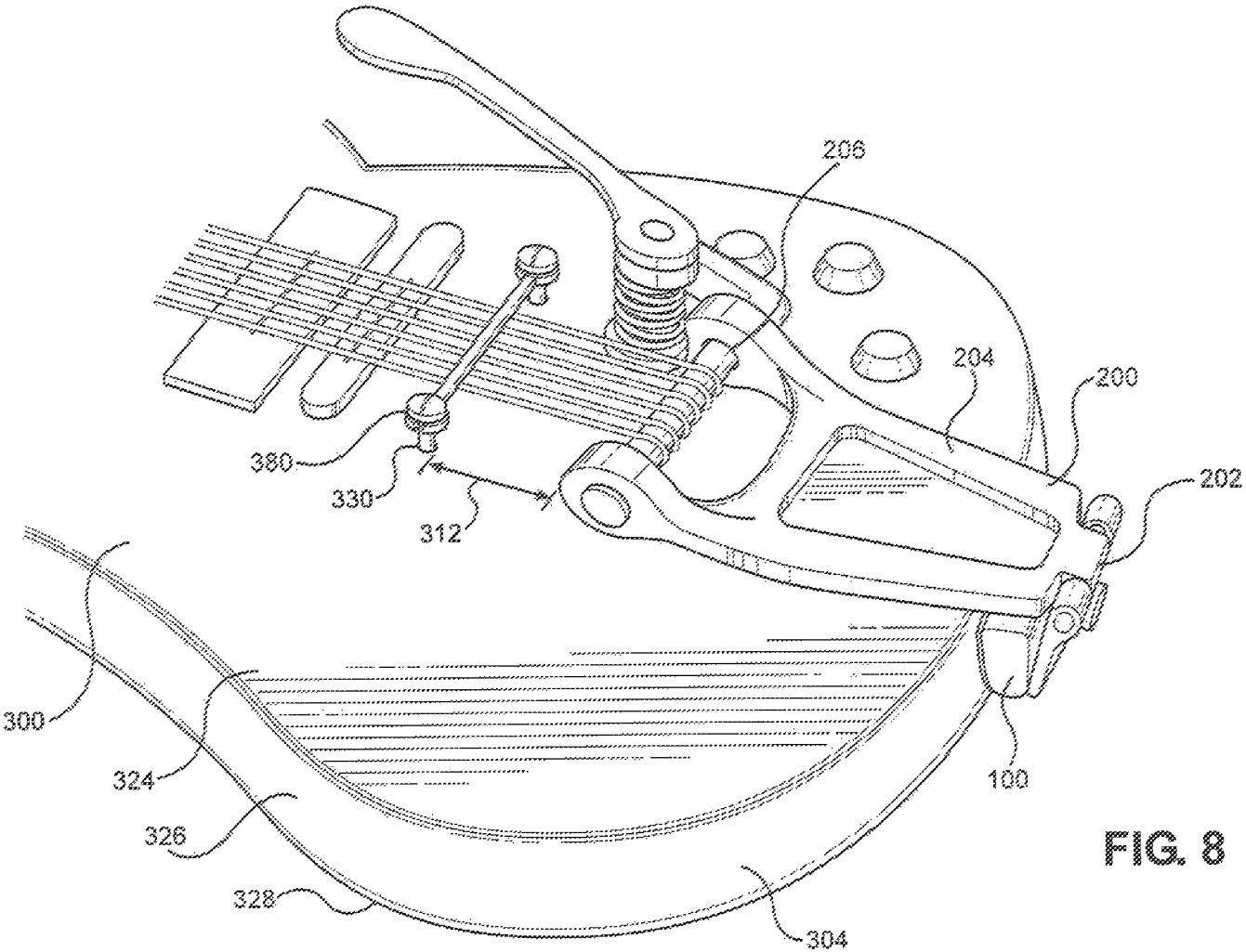
FIG. 8 is a perspective view of a vibrato device attached to a guitar without any physical modifications by utilizing the Vibrato block with a Vibrato Retrofit String Tension Kit mounted in the stock location of the tailpiece.

Referring now to FIG. 8, a perspective view of the guitar 300 is shown with the Vibrato Block 100, the vibrato device 200, and a Vibrato Retrofit String Tension Kit 380. The Vibrato Retrofit String Tension Kit 380 is fully described in U.S. Pat. No. 7,973,226 and is fully incorporated herein. The thickness 108 of the Vibrato Block 100 spaces the vibrato device 200 a distance 312 away from the tailpiece mounting holes 330. The distance 312 allows the tailpiece mounting holes 330 to be unobstructed and available to mount the Vibrato Retrofit String Tension Kit 400. The Vibrato Retrofit String Tension Kit 400 utilizes the tailpiece mounting holes 330 as its own mounting holes thereby avoiding permanent physical modifications to the guitar 300. By attaching the Vibrato Retrofit String Tension Kit 400, an extra degree of adjustment is available for the user to tune their guitar.

Figure 9:
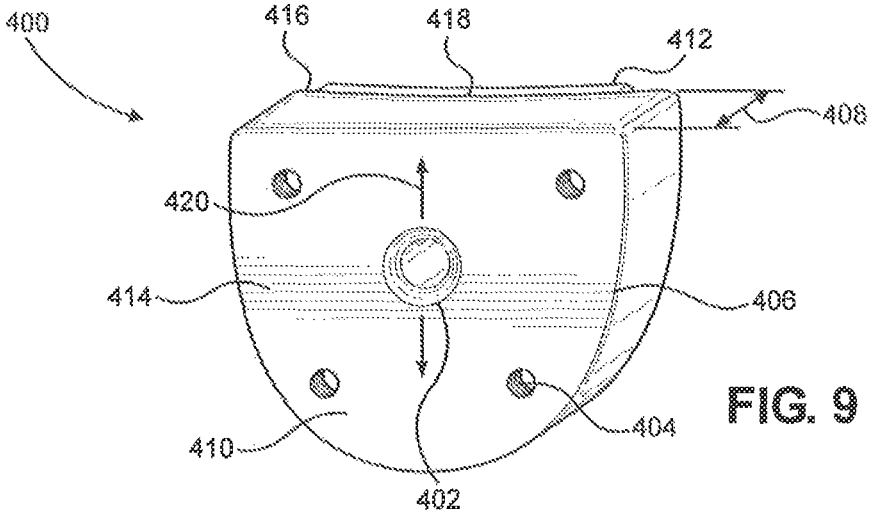
FIG. 9 is a perspective view of the Vibrato Block of the present invention depicting the overall dimensions of the Vibrato block, the mounting bore having a countersink, the mounting points, the thickness, and the non-marring, high friction pad.

Referring to FIG. 9, a perspective view of an alternative embodiment of the Vibrato Block of the present invention is shown and generally designated 400. Vibrato Block 400 includes a main body 410 having a front mounting plate surface 414, a rear guitar contact surface 416 having a slight curvature 418, a mounting hole 402 formed with a countersink extending between the front mounting plate surface 414 and rear guitar contact surface 416. Block 400 is formed with a plurality of mounting holes 404, has a footprint 406, a thickness 408, and a non-marring, high-friction pad 412. In approximately the center of body 410 is mounting bore 402. The plurality of mounting holes 404 are formed on the front mounting plate surface 414 of body 410 and are spaced in predetermined locations. In the preferred embodiment, there are four mounting holes 404 with each mounting hole threaded to receive a corresponding screw. The non-marring, high-friction pad 412 is located on the rear guitar contact surface 416 of the body 410 and can be a floating pad, an attached pad, or a material directly coated onto the rear guitar contact surface 416. The use of the non-marring, high friction pad 412 is optional and the Vibrato Block 400 may be used without it.

Figure 10:
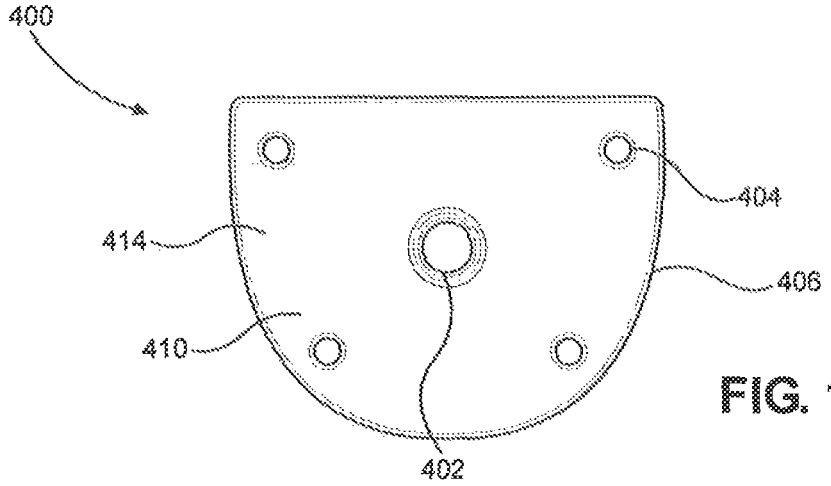
FIG. 10 is a plan view of the Vibrato Block of the present invention showing the footprint, the mounting bore having a countersink, and mounting points.

Referring now to FIG. 10, a front view of the Vibrato Block 400 of the present invention is shown. The bore 402 is placed approximately in the middle of the body 410 and extends all the way through, from the front mounting plate surface 414 to the rear guitar contract surface 416. The position of the mounting bore 402 may vary in direction 420 as determined in order to align with the placement of the Vibrato Device on the side of the guitar body 326. The mounting holes 404 are placed in the body 410 on the front mounting plate surface 414. The body 410 has a footprint 106 defined by the front mounting plate surface 414.

Figure 11:
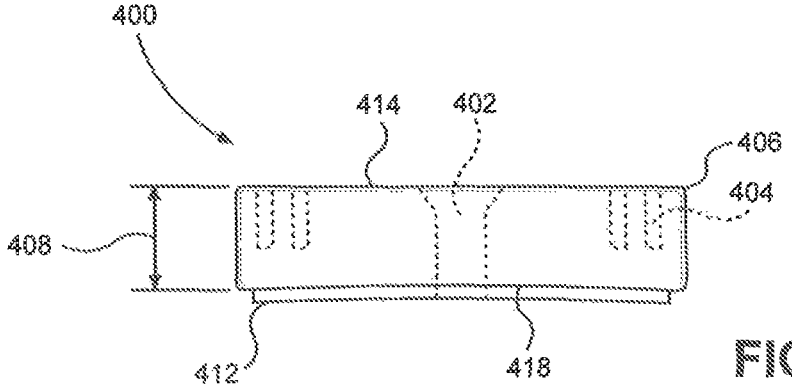
FIG. 11 is a top view of the Vibrato Block of the present invention showing the thickness of the Vibrato Block.

Referring now to FIG. 11, a top view of the Vibrato Block 400 of the present invention is shown. The non-marring, high-friction pad 412 is located on the rear guitar contact surface 416 of the body 410. At approximately the center of the body 410 is mounting bore 402. The mounting holes 404 are located towards the edge of the body. The thickness 408 of the vibrato device 200 (shown this Figure) is predetermined based on the spacing needed to position the attached vibrato device 200 for perfect alignment and spacing.

The curvature 418 corresponds to the curvature of the guitar body in which the Vibrato Block 400 is being attached to. The curvature 418 ensures the maximum amount of contact area with the guitar body to provide greater stability and strength to the Vibrato Block 400 and attached vibrato device 200. In certain guitar types, a curvature 418 may not be needed and a flat rear guitar contact surface area may be preferred. The non-marring, high-friction pad 412 increases the stability and strength of the Vibrato Block 400 by providing additional friction between the surfaces and deforming to fill any gaps between the Vibrato Block 400 and the guitar. The use of the non-marring, high friction pad 412 is optional and the Vibrato Block 100 may be used without it. Differing thicknesses 408 and curvatures 418 for the Vibrato Block 400 to accommodate different types of vibrato devices and guitars are fully contemplated without departing from the scope and spirit of the invention.

While there have been shown what are presently considered to be preferred embodiments of the present invention, it will be apparent to those skilled in the art that various changes and modifications can be made herein without departing from the scope and spirit of the invention.

The invention claimed is:

1. A guitar vibrato assembly comprising:

a guitar having a front surface, a removable rear button screw mount formed with internal threads, and tailpiece mounting holes located on the front surface;

a vibrato device having a rear mounting plate formed with a plurality of mounting holes and an internal slot;

a vibrato block having a front surface area, a back surface area, and a predetermined thickness, said block formed with an internal slot extending between the front surface and the back surface and a plurality of mounting holes corresponding with said mounting holes of said rear mounting plate of said vibrato device, said vibrato block positioned between said mounting plate of said vibrato device and said rear strap button screw mount of said guitar;

a rear strap button screw insertable through said internal slot of said vibrato device and said internal slot mounting hole of said vibrato block and threadable into said rear strap button screw mount of said guitar; wherein said tailpiece mounting holes remain unobstructed and available to mount an additional guitar accessory, wherein said back surface area has a curvature.

2. The guitar vibrato assembly of claim 1, wherein said vibrato block further comprises:

a pad attached to said back surface area.

3. The guitar vibrato assembly of claim 1, wherein said vibrato device mounting plate further comprises:

a main plate having a first end and a second end, said first end hingedly attached to said mounting plate;

a string hold bar rotatably attached to said second end of said main plate; and a control lever fixedly attached to said vibrato bar.

4. The guitar vibrato assembly of claim 1, wherein said vibrato block front surface area is substantially equal to said mounting plate mount surface area.

5. The guitar vibrato assembly of claim 1, further comprising a vibrato block fastener comprising a head and external threads corresponding to said internal threads of said rear strap button screw mount.

6. The guitar vibrato assembly of claim 1, wherein said vibrato block's internal slot is further formed with a counterbore.

7. The guitar vibrato assembly of claim 5, wherein said fastener is a rear strap button screw.

8. A vibrato block used to mount a vibrato device to a guitar, the vibrato device having a mounting plate formed with a plurality of mounting holes and a rear strap button pass through, the guitar having a rear strap button screw, a front surface, a rear strap button screw mount, and tailpiece mounting holes located on the front surface, the vibrato block comprising:

a body, said body having a front surface, a curved back surface, and a predetermined thickness;

an internal slot formed into said body extending between said front surface and said back surface adapted to receive said rear strap button screw;

a plurality of mounting holes formed in said body, said mounting holes formed in said front surface corresponding to said plurality of mounting holes of said mounting plate;

wherein said vibrato block is mounted to said rear strap button mounting hole with a button screw and said vibrato device is attached to said vibrato block mounting holes; and whereby the vibrato device is mounted to the guitar using said vibrato block, said rear strap button mount, and said rear button strap screw without physical modification to said guitar, and wherein the vibrato device is mounted such that the tailpiece mounting holes are not obstructed or otherwise blocked.

9. The vibrato block of claim 8 further formed with a thickness, said thickness predetermined to create a placement of said vibrato device when mounted such that and said tailpiece mounting holes remain unobstructed.

10. The vibrato block of claim 8 further formed with a non-marring, high-friction pad attached to the curved back surface.

11. A method of attaching a vibrato device to a guitar without permanent physical alteration to said guitar, including the steps of:

providing a guitar having a body, a tail piece, tail piece mounting holes, guitar strings, a bridge, a rear strap button screw mounting hole, and a rear strap button screw having a button with a threaded protrusion;

providing a vibrato device with a rear mounting plate formed with a plurality of mounting holes and a rear strap button screw pass-through hole, a main plate hingedly attached to said rear mounting plate at a first end and a string hold bar rotatably attached at a second end, and a vibrato bar fixedly attached to said string hold bar;

providing a vibrato block having a curved back surface, an internal slot sized to form a clearance fit with said threaded protrusion of said rear strap screw button, and a plurality of mounting points corresponding to said mounting points of said rear mounting plate of said vibrato device;

removing guitar strings from said tail piece;

removing said the tail piece from said tail piece mounting holes;

removing the rear strap button screw from said rear strap button screw mounting hole;

mounting said vibrato block to said rear strap button screw mounting hole;

mounting said vibrato device to said vibrato block, ensuring said tail piece mounting holes are unobstructed by said vibrato device;

attaching guitar strings to said vibrato device; and adjusting said vibrato block and attached vibrato device to achieve the desired position of said vibrato device and attached guitar strings.

12. The method of attaching a vibrato device to a guitar without permanent physical alteration to said guitar of claim 11, said step of mounting said vibrato block to said rear strap button screw mounting hole further comprises the steps of:

aligning said internal slot of said vibrato block with said rear button strap screw mounting hole; and inserting said rear button strap screw through said internal slot and threading said rear buttons strap screw to rear button strap screw mounting hole.

13. The method of attaching a vibrato device to a guitar without permanent physical alteration to said guitar of claim 11, wherein said step of mounting said vibrato device to said vibrato block, ensuring said tail piece mounting holes are unobstructed by said vibrato device further comprises the steps of:

aligning said mounting holes of said vibrato device with corresponding mounting holes of said vibrato block; and inserting a corresponding screw through said mounting plate mounting holes and threading said screw into said mounting hole of said vibrato block.

14. The method of attaching a vibrato device to a guitar without permanent physical alteration to said guitar of claim 11, wherein said step of adjusting said vibrato block and attached vibrato device to achieve the desired position of said vibrato device and attached guitar strings further comprises the steps of:

loosening said rear strap button screw to allow enough clearance for said vibrato block and attached vibrato device to freely traverse along said internal slot;

positioning the said vibrato block and attached vibrato device to the desired position; and retightening said rear strap button screw to produce adequate friction force between said vibrato block and guitar body to prevent said vibrato block and attached vibrato block from moving.

15. The method of attaching a vibrato device to a guitar without permanent physical alteration to said guitar of of claim 11 further comprising the step of attaching a guitar accessory to said unobstructed tailpiece mounting holes.

* * * * *

UNITED STATES PATENT AND TRADEMARK OFFICE

CERTIFICATE OF CORRECTION

PATENT NO. : 9,142,197 B2
APPLICATION NO. : 14/203441
DATED : September 22, 2015
INVENTOR(S) : Andrew Oldfield It is certified that error appears in the above-identified patent and that said Letters Patent is hereby corrected as shown below:

Claims

Column 10, line 51, claim 15, change "of of" to -of-

Signed and Sealed this
Second Day of February, 2016

Michelle K. Lee

Michelle K. Lee
*Director of the United States Patent and Trademark Office*